US005674571A

United States Patent [19]

Focke et al.

[11] Patent Number: 5,674,571

[45] Date of Patent: Oct. 7, 1997

[54] METHOD AND APPARATUS FOR THE COATING OF LIQUIDS ONTO FILM WEBS, PARTICULARLY OF COLOR PRINTS

[75] Inventors: Heinz Focke; Johann Köster, both of Verden, Germany

[73] Assignee: Focke & Co. (GmbH & Co.), Verden, Germany

[21] Appl. No.: 597,070

[22] Filed: Feb. 5, 1996

[30] Foreign Application Priority Data

Apr. 19, 1995 [DE] Germany ..... 195 13 888.0

[51] Int. Cl.[6] ..... B05D 1/28; B05C 1/08

[52] U.S. Cl. ..... 427/428; 427/345; 427/256; 118/258; 118/259; 118/263; 118/693; 118/694

[58] Field of Search ..... 427/428, 345, 427/256; 118/248, 249, 258, 259, 693, 694, 263

[56] References Cited

U.S. PATENT DOCUMENTS

| | | | |
|---|---|---|---|
| 3,044,396 | 7/1962 | Aller | 101/157 |
| 3,854,446 | 12/1974 | Stievenart et al. | 118/223 |
| 4,264,644 | 4/1981 | Schaetti | 427/55 |
| 4,287,846 | 9/1981 | Klein | 118/212 |
| 4,339,481 | 7/1982 | Beekhuis | 427/428 |
| 4,497,274 | 2/1985 | Focke | 118/221 |
| 4,503,802 | 3/1985 | Keller et al. | 118/249 |
| 4,581,995 | 4/1986 | Stone | 101/336 |
| 4,615,295 | 10/1986 | Wittkopf | 118/261 |
| 5,180,612 | 1/1993 | Rendell | 427/372.2 |
| 5,335,596 | 8/1994 | DeMoore et al. | 101/350 |
| 5,372,670 | 12/1994 | Cummings et al. | 156/390 |

FOREIGN PATENT DOCUMENTS

| | | | |
|---|---|---|---|
| 0339159 | 11/1989 | European Pat. Off. . | |
| 339159 | 11/1989 | European Pat. Off. | B41F 23/08 |
| 359955 | 3/1990 | European Pat. Off. . | |
| 368485 | 5/1990 | European Pat. Off. | B41F 31/02 |
| 0574124A1 | 12/1993 | European Pat. Off. . | |
| 0619186A1 | 10/1994 | European Pat. Off. . | |
| 9107179.8UI | 9/1991 | Germany . | |
| 4118426A1 | 12/1992 | Germany . | |
| 4126722A1 | 2/1993 | Germany . | |
| 4203162C2 | 5/1993 | Germany . | |
| 4138807C1 | 6/1993 | Germany . | |
| 4311834A1 | 10/1994 | Germany . | |
| 4342303A1 | 6/1995 | Germany . | |
| 346565 | 5/1960 | Switzerland . | |
| 570267 | 12/1975 | Switzerland . | |
| 434107 | 5/1934 | United Kingdom . | |
| 515437 | 6/1938 | United Kingdom . | |
| 9207719 | 5/1992 | WIPO . | |
| PCT/US91/07989 | 5/1992 | WIPO | B41F 31/02 |

*Primary Examiner*—Shrive Beck
*Assistant Examiner*—Michael Barr
*Attorney, Agent, or Firm*—Abelman, Frayne & Schwab

[57] ABSTRACT

Method and apparatus for the coating of liquids, particularly of colour markings, onto film webs or the like. A printing unit (16) serves for the transfer of especially small colour markings to film webs. In the printing unit (16), a dye roller (25) dips from above into a dye chamber (24) which is open at the top and takes up dye by means of a rotating movement. This dye flows constantly or intermittently through the dye chamber (24) which is dimensioned to be relatively small. The dye can be fed to the dye chamber (24) from a reservoir (43) via a feed conduit (45) or discharged from the dye chamber (24) to another reservoir via a discharge conduit (46). A further particularity consists in measures for the improvement of the proofness by sucking off dye residues on the dye roller (25) by means of suction conduits (74, 76).

13 Claims, 9 Drawing Sheets

METHOD AND APPARATUS FOR THE COATING OF LIQUIDS ONTO FILM WEBS, PARTICULARLY OF COLOR PRINTS

The invention relates to a method for the coating of liquids onto material webs or blanks, consisting particularly of plastic, for example for the application of colour markings consisting of dyestuffs onto film webs, with a printing unit which has a dye chamber and a dye-transfer member, preferably a rotating dye roller. The invention relates, furthermore, to an apparatus for carrying out the method.

In the transfer of liquid substances onto material webs, particularly when dyestuffs are applied to film webs or blanks consisting of plastic, there is a number of difficulties to be borne in mind. On the one hand, the exact metering of the dyestuff quantity for the print surfaces or colour markings is important. On the other hand, care must be taken to ensure that, even when there is little consumption of dyestuff, its consistency is preserved over a relatively long period of time for the transfer operation. Finally, in the case of movable dye-transfer members, in particular rotating dye rollers, sealing problems have to be solved.

The difficulties become particularly evident when small colour markings are transferred onto film webs for the outer wrapping of cigarette packs, in order to identify the gripping end of an otherwise transparent tear-open strip of the film. In this case, the colour marking is usually not printed onto the tear-open strip, but in the region of the gripping end of the latter onto the (carrier) film.

It is customary, for this purpose, to use in the packaging machine a printing unit which extracts dyestuff from a dye chamber by means of a rotating printing roller and transfers it onto a plate roller. This in turn takes up the dyestuff in the region of a plate and transfers the predetermined marking onto the film web.

The object on which the invention is based is to improve the use of the printing unit in conjunction with packaging machines or other production plants, in such a way that no faults occur over a lengthy operating period, in particular on account of a variation in the dyestuff, leakiness or defective dyestuff transfer.

To achieve this object, the method according to the invention is characterized in that the dyestuff flows through the dye chamber constantly or intermittently, in particular as a result of pressure acting on the dyestuff on an inlet side and/or negative pressure on an outlet side of the dye chamber.

The constant, continuous or intermittent circulation of the dyestuff in a closed circuit guarantees that its consistency does not vary appreciably even over a relatively long period of time. Transferability onto the film is preserved.

To rectify or allow for deficient sealing in the region of the printing unit, according to a further proposal of the invention, sealing regions between the (movable) dye-coating member and the dye chamber are subjected to negative pressure, in such a way that any residues of the liquid or dyestuff are sucked off constantly or from time to time.

This also independently applicable feature of the invention takes account of the fact that material residues can escape in the region between fixed sealing surfaces, on the one hand, and surfaces bearing slidably on these and belonging to the movable, in particular rotating dye-coating member. These material residues are eliminated by being sucked off, preferably constantly, in the region of the sealing surfaces of the dye chamber.

The apparatus according to the invention is designed in such a way that a relatively small dye chamber is connected to a circulation conduit for the dyestuff. The dyestuff circulates constantly or, according to a preferred exemplary embodiment, is conveyed from one reservoir into another and back. During this conveying operation, the dyestuff runs through the dye chamber. The reservoirs are alternately subjected to compressed air and/or connected to a negative pressure source.

The reservoirs are provided with sensing and checking members which monitor the emptying and filling operations, the changeover of the direction of flow and the consumption of dyestuff and which trigger the necessary control signals.

According to a further feature of the invention, the dye chamber is arranged underneath the dye roller, so that the rotating dye roller extracts the dyestuff from the dye chamber by means of a lower circumferential region.

In an independently applicable design of the apparatus, the rotary-driven dye roller bears on cylindrical sealing surfaces of the dye chamber. Suction bores open out in the region of these sealing surfaces for the purpose of discharging any residual quantities of liquid or dyestuff.

BRIEF DESCRIPTION OF THE DRAWINGS

Further particulars of the invention are explained in more detail below by means of the drawings. In these:

FIGS. 1 and 2 show a preferred field of use of methods and apparatuses for the coating of colour markings 10 onto a carrier, in the present case onto a film web 11. This is a blank 12 for an outer wrapping of a (cigarette) pack. The blank 12 is separated from the film web 11 in the region of a packaging machine (not shown) and is then folded round the (cigarette) pack. The film web 11 and therefore the blank 12 consist of transparent material.

Figure 1:
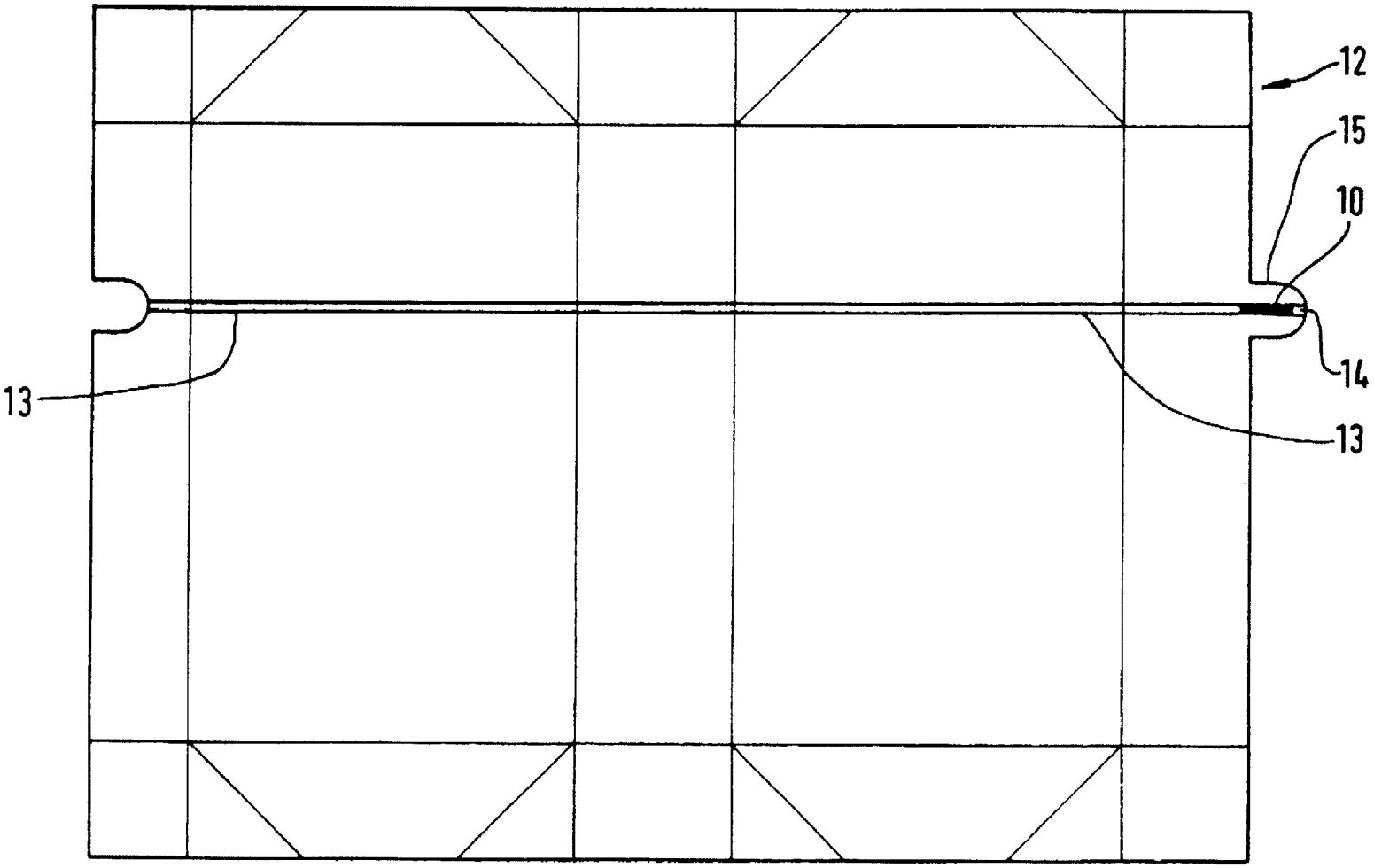
FIG. 1 shows a blank of an outer wrapping of a (cigarette) pack in the spread-out position.
Figure 2:
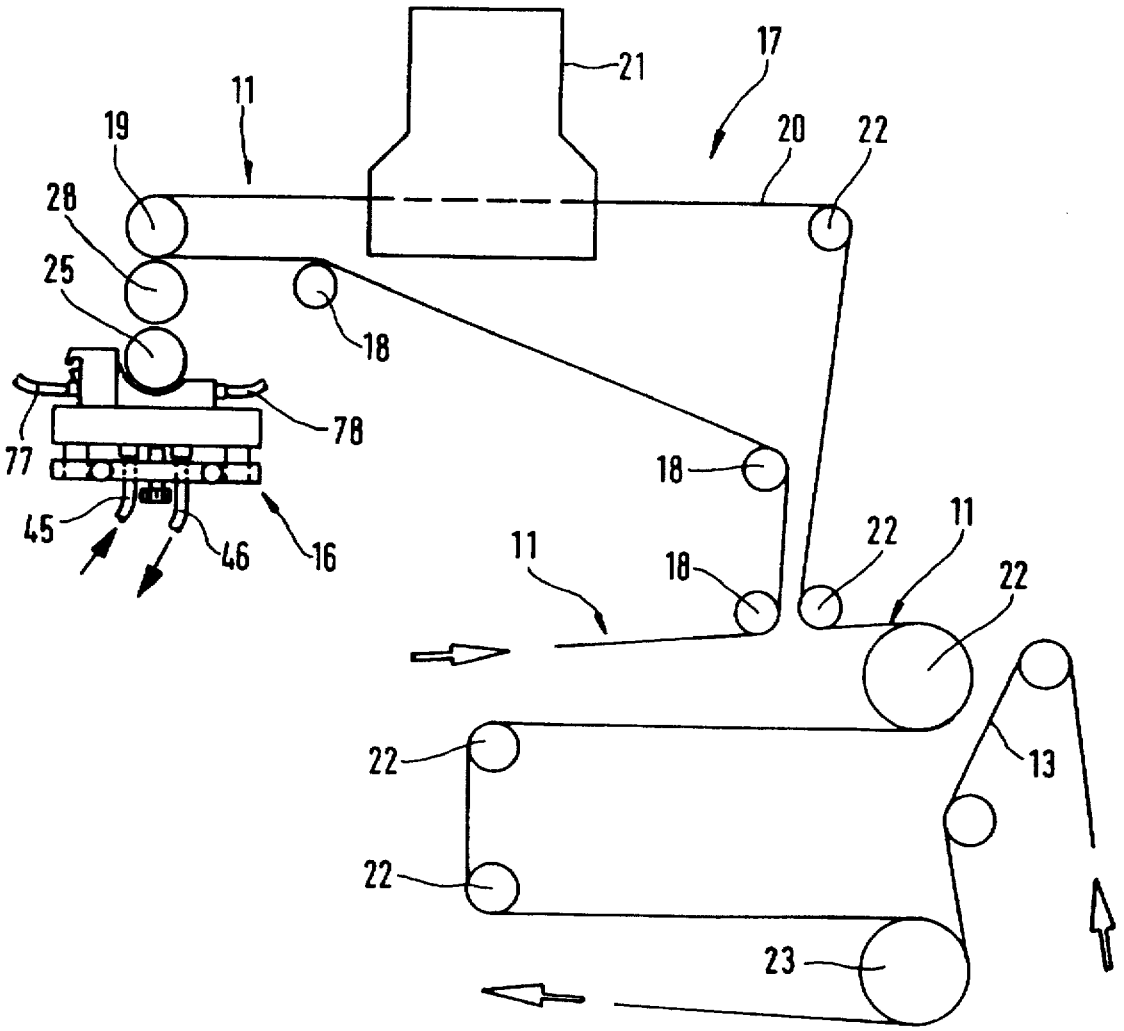
FIG. 2 shows a diagrammatical representation of an apparatus with a dye assembly as part of a packaging machine.

To open the outer wrapping of the (cigarette) pack when it is used for the first time, the blank 12 is provided with a tear-open strip 13. This extends, here, in the longitudinal direction of the blank 12. The tear-open strip 13 is usually sealed onto the film web 11 or the blank 12 on the inside. To take hold of an exposed gripping end 14 of the tear-open strip 13, the blank 12 is provided with a tongue 15 at the free edge.

If the tear-open strip 13 likewise consists of transparent material for visual reasons, the gripping end 14 can be recognized only with difficulty. For this purpose, the colour marking 10 is applied in the region of the gripping end 14. The strip-shaped colour marking 10, elongate here, is set in sharp contrast to the blank 12 and tear-open strip 13, so that the gripping end 14 can be recognized easily.

The colour marking 10 is applied in the region of the packaging machine, that is to say before or during the formation of the blank 12, by means of a printing unit 16. In the present case, the colour marking 10 is coated on the inside of the blank 12 or of the film web 11, in the region of the tear-open strip 13 or of the gripping end 14. In the finished pack, therefore, the colour marking 10 is located on the inside of the outer wrapping, that is to say on the blank 12, and is covered towards the inside by the tear-open strip 13.

The printing unit 16 is part of a marking assembly 17 which is assigned to a packaging machine. To apply the colour markings 10, the film web 11 is fed to the printing unit 16 via deflecting rollers 18. Here, the colour marking 10 is transferred exactly in position onto the film web 11 in the region of a back-up roller 19. The film web 11 then runs, in the region of a horizontal conveying stage 20, through a hardening assembly, in particular a UV hardener 21. By means of this, the dyestuff of the colour marking 10, reacts to UV rays, is hardened within a short time.

The film web 11 provided with the colour marking 10 then passes via further deflecting rollers 22 into the region of a connecting roller 23. On the circumference of the latter, a continuous material strip is fed as a tear-open strip 13 to the outside of the film web 11. This material strip is laid onto the film web 11 and is connected in a correct position for the pack to the film web 11 by sealing or adhesive bonding.

The blanks 12 shown in FIG. 1 are separated in succession, in the region of a separating station (not shown), from the film web 11 provided with colour markings 10 and with a continuous tear-open strip 13 and are introduced into the packaging process.

The dyestuff for the colour markings 10 is received in a dye chamber 24 of the printing unit 16. The dyestuff is extracted from the dye chamber 24 by a dye-transfer member. In the present case, this is a rotating dye roller 25. During the rotational movement about a horizontal axis, this dips with a part region of the cylindrical circumference from above into the dye chamber 24 and therefore into the supply of dyestuff located in the dye chamber 24. A layer of dyestuff is taken up on the circumference of the dye roller 25. For this purpose, the dye roller 25 is designed completely or partially as a screen roller with small depressions in the μ range. The dye layer on the dye roller 25 thus designed is metered by a stripper 26. This is designed as a doctor blade.

In the present exemplary embodiments, the dye roller 25 is provided with strip-shaped transfer regions 27, that is to say with strip-shaped regions which extend along the circumference and which are made screen-like in the way described, in order to transport dyestuff. Depending on the print pattern to be produced, the transfer regions 27 are of differing width, namely relatively narrow in the exemplary embodiment of FIG. 5 and, in relation to this, wide in the exemplary embodiment of FIG. 10. The latter can be used for the transfer of prints of relatively large format onto print carriers consisting of plastic or the like.

In the present case, the dye roller 25 transfers dyestuff onto a further transfer roller arranged above it, namely onto a plate roller 28. This is mounted axis-parallel to the dye roller 25 and is provided on its circumference with a receiving piece for dyestuff, namely with a plate 29. This corresponds in shape, size and position to the colour marking 10. As a result of the rotational movement of the plate roller 28, the plate 29 provided with dyestuff is fed to the film web 11 in the region of the back-up roller 19. The colour marking 10 is transferred exactly in terms of size and position from the plate 29 onto the film web 11. As regards other prints to be produced, the plate is designed correspondingly, that is to say can also consist of letters.

Figure 4:
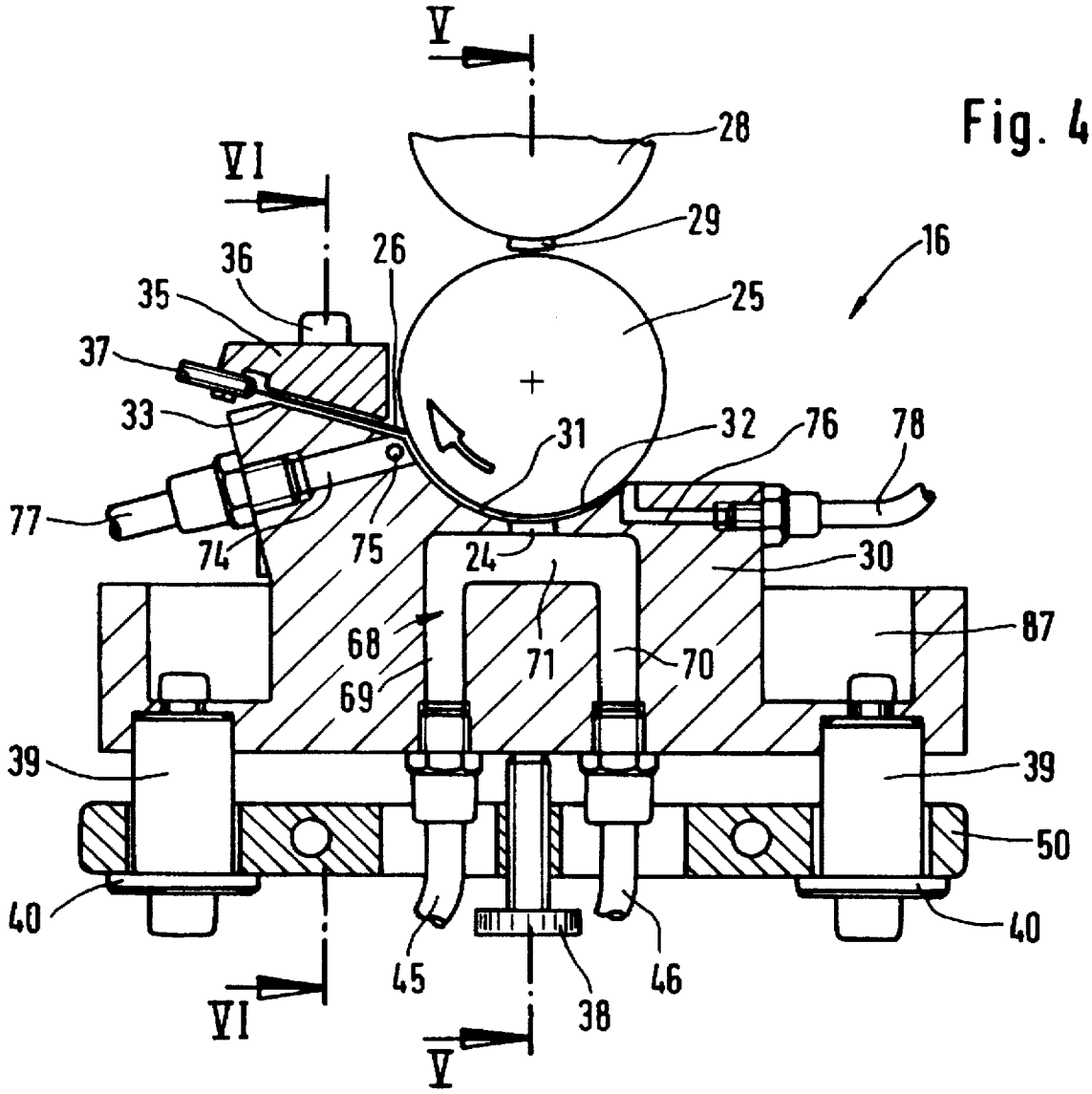
FIG. 4 shows a vertical section through a printing unit as part of the dye assembly on an enlarged scale.

The dye chamber 24 is located in a dye container 30 designed here as a material block. Within the dye container, the dye chamber 24 is designed as an upwardly open slit-like or groove-shaped depression or recess. In the exemplary embodiment according to FIG. 4 and FIG. 5, the dye chamber 24 extends as a relatively small recess with a larger dimension in the circumferential direction of the dye roller 25 (FIG. 4). In the axial direction of the dye roller 24, the dye chamber 24 extends centrally relative to the strip-shaped transfer region 27. As is evident from FIG. 5, the dye chamber 24 has a markedly smaller width than the transfer region 27 on the dye roller 25.

In the circumferential direction of the dye roller 25, cylindrically shaped sealing surfaces 31 and 32 are adjacent to the dye chamber 24 on both sides. The sealing surfaces 31, 32 nestle closely against the circumference of the dye roller 25. The sealing surface 31 adjacent to the dye chamber 24 in the direction of rotation of the dye roller 25 (arrow) has larger dimensions in the direction of rotation than the entry-side, that is to say opposite, sealing surface 32. The dye roller 25 bears on the sealing surfaces 31, 32 virtually without a gap.

The stripper 26 is positioned on the exit side or on the free end region of the sealing surface 31, specifically at an inclination to the cylindrical surface of the dye roller 24. As is evident from FIGS. 4 and 6, the stripper 26 is located on an inclined supporting surface 33 of the dye container 30. The material block for forming the dye container 30 is designed, in this region, as a web 34 of reduced width. A holding piece 35 made U-shaped in cross-section is placed from above onto the stripper 26 or the web 34, so that supporting legs extend on both sides of the web 34. Fastening screws 36 actuable from above pass through these supporting legs in order to fasten the holding piece 35 to the dye container 30 or to a base of the latter. The stripper 26 is accordingly braced between the web 34 and holding web 35. An adjusting screw 37 arranged at the end of the stripper 26 serves for resetting or adjusting the latter.

The dye chamber 24 or the dye container 30 is mounted in such a way that exact alignment with the dye roller 25 can take place. For this purpose, in the present case, the dye container 30 is mounted adjustably as a whole on a carrier, namely on a carrier plate 50 connected to the packaging machine (housing). The dye container 30 or its bottom wall is supported on the carrier plate 50 via setscrews 38. Provided additionally are guide bolts 39 which, on the one hand, are connected to the dye container 30 and, on the other hand, via stop washers 40 absorb the counterforces resulting from the supporting effect of the setscrews 38. The guide bolts 39 are seated in relatively large bores of the carrier plate 50. For the exact setting of the dye container 30 in relation to the dye roller 25, therefore, the setscrews 38 are extended upwards or retracted by rotation.

The carrier plate 50 is connected via horizontal connecting bolts 41 to a vertical carrier wall 42 of the machine stand. The dye roller 25 and the plate roller 28 are also mounted on this carrier wall 42 so as to project on one side.

A further special feature of the apparatus is that the dyestuff flows through the dye chamber 24 constantly or intermittently. Consequently, no standing supply of dyestuff, decreasing constantly as a result of consumption, is kept ready in the dye chamber 24. On the contrary, the dyestuff is constantly in circulatory motion.

In the exemplary embodiment shown, the dyestuff is circulated constantly in a closed circuit. For this purpose, two reservoirs 43, 44 for dyestuff are provided. The dyestuff is fed from one reservoir 43 to the dye chamber 24 via a feed conduit 45 and is extracted from the dye chamber 24 again to approximately the same extent via a discharge conduit 46. The discharge conduit 46 guides the dyestuff into the other reservoir 44. The latter gradually receives the entire supply of dyestuff, less the continually consumed quantity. After the reservoir 43 has been emptied, a changeover operation takes place. Then, with the direction of flow being reversed, the dyestuff is conveyed out of the (filled) reservoir 44 back into the reservoir 43, specifically always flowing through the dye chamber 24.

In the present exemplary embodiment, the flow action is brought about by a pressure medium, namely compressed air. The particular reservoir 43 which is in the process of being emptied is connected via an air conduit 47 to a compressed-air source, for example a pump P. The air conduit 47 opens out in the upper region of the reservoir 43, at all events above the dyestuff level. The excess pressure acting on the dyestuff is, for example, 0.3 to 0.7 bar.

An air conduit 48 is also connected to the reservoir 44 in a similar way to the reservoir 43. This air conduit 48 can act as a bleed conduit during the conveyance of the dyestuff from the reservoir 43 into the reservoir 44. However, a design in which the compressed air acting on one reservoir 43, 44 is assisted by negative pressure in the other reservoir 44, 43 is particularly advantageous. In the operating state shown, therefore, the air conduit 48 is connected to a vacuum source V. This can, for example, be a vacuum pump of the ejector-pump type. Ejector pumps operated by compressed air are known in various embodiments as a vacuum pump.

The two air conduits 47, 48 are connected to a slide 49. Depending on the switching position, this makes a connection of one or other air conduits 47, 48 to the pump P or to the vacuum source V.

Figure 7:
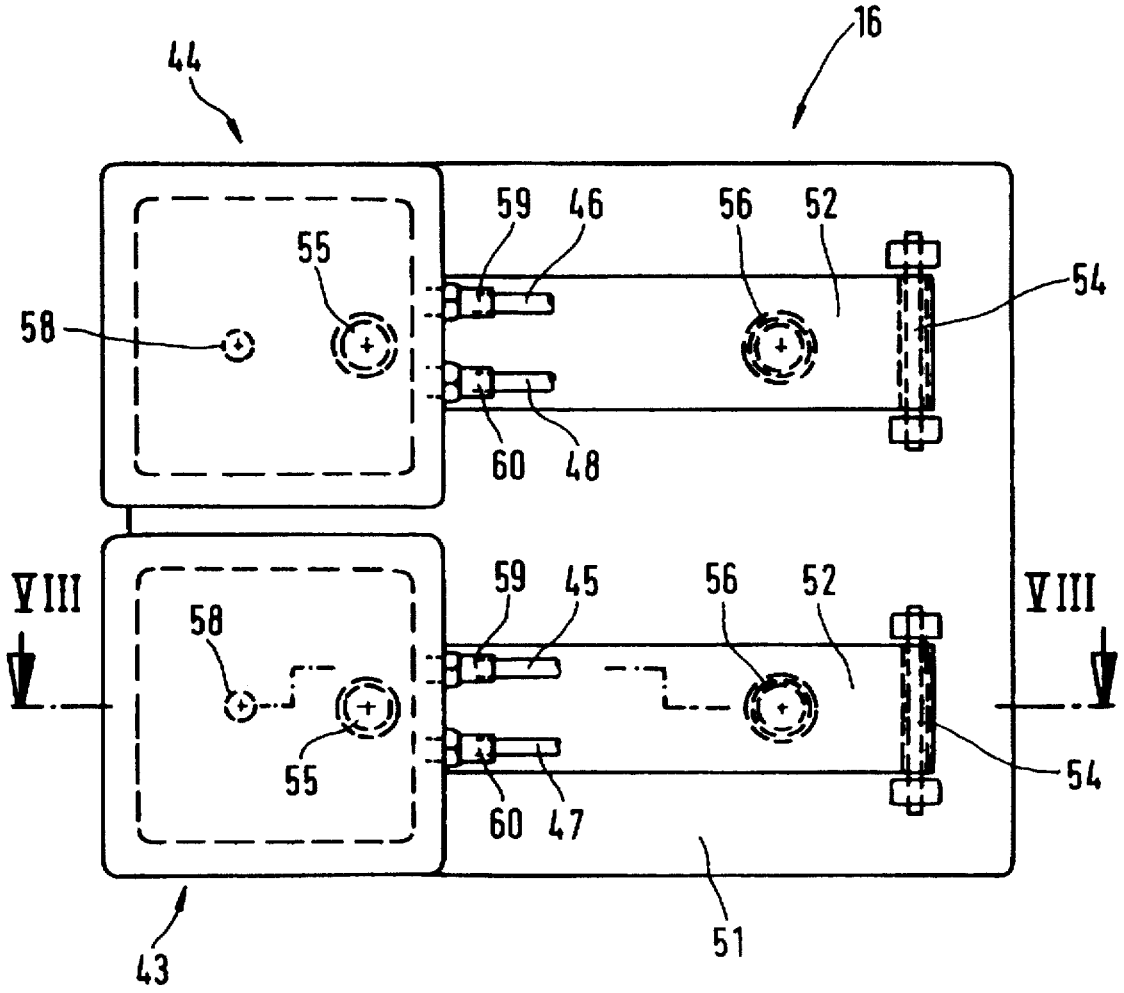
FIG. 7 shows a top view of two reservoirs for dyestuff as part of the dye assembly.
Figure 8:
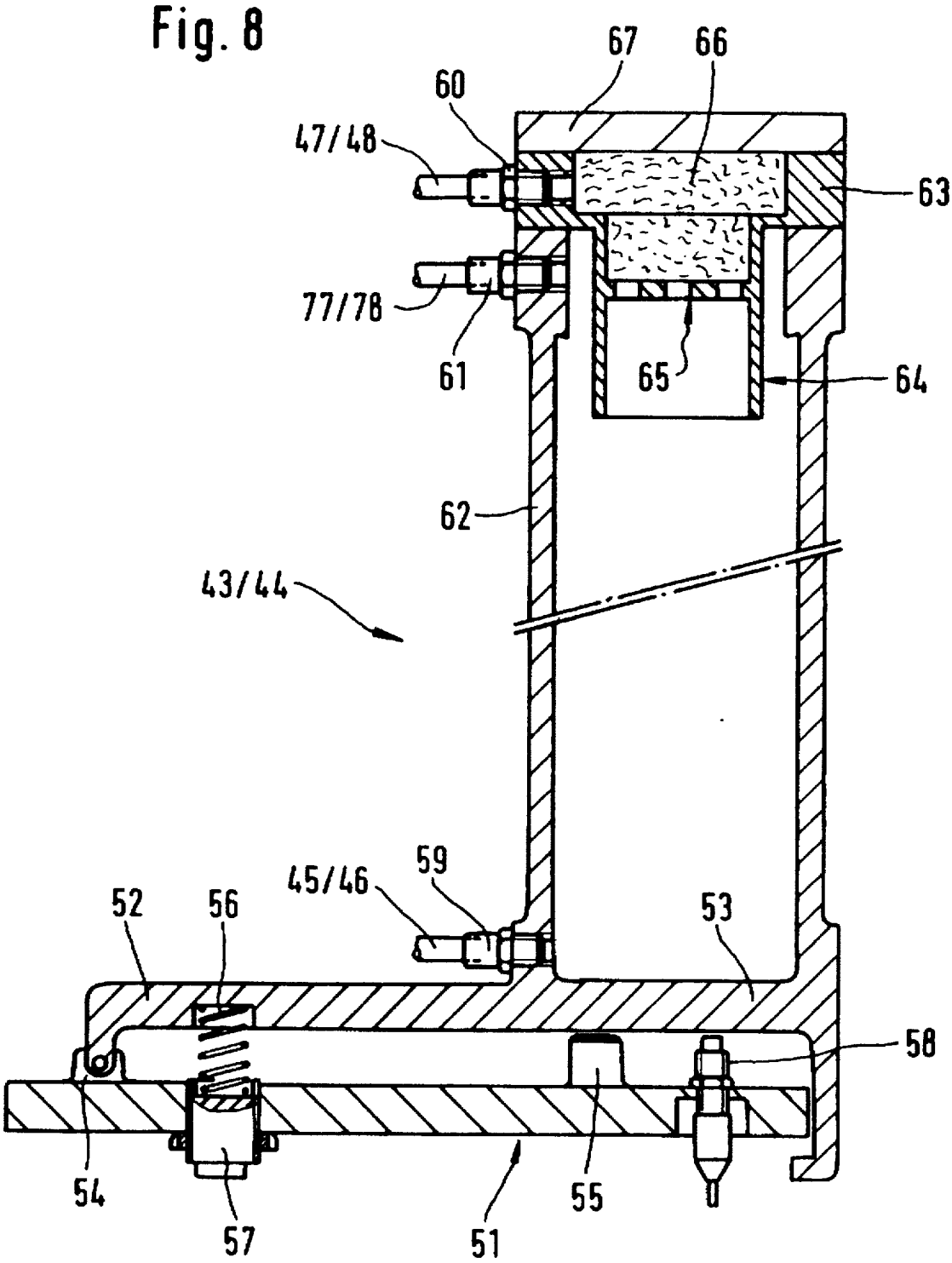
FIG. 8 shows one of the reservoirs according to FIG. 7 in vertical section in a sectional plane VIII—VIII of FIG. 7.

An advantageous design of the reservoirs 43, 44 emerges from FIGS. 7 and 8. According to these, the two reservoirs 43, 44 are mounted on a common support plate 51. This is connected fixedly to the machine stand in a suitable way. The reservoirs 43, 44 are mounted on the support plate 51 so as to be movable, namely pivotable, independently of one another. A control signal is derived from the relative position in accordance with the degree of filling of the respective reservoir 43, 44.

A lower supporting leg 52 projecting on one side is attached as a continuation of a bottom wall 53 to each of the elongate reservoirs 43, 44. The supporting leg 52 is connected by means of its free angled end to the support plate 51 via a pivot bearing 54. The reservoir 43, 44 is pivotable about this pivot bearing 54, specifically until it comes to bear on a fixed stop 55 underneath the bottom wall 53. The bearing of the reservoir 43, 44 on this stop 55 defines the lower end position of the respective reservoir 43, 44 when it is filled completely with dyestuff.

The reservoir 43, 44 is supported resiliently elastically on the support plate 51. In the present case, a spring element is arranged in the support plate 51 in the region of each reservoir 43, 44, with a compression spring 56 and a setscrew 57 for setting the spring force. The supporting leg 52 rests on the compression spring 56 in the region of a depression.

The minimum filling level of the reservoir 43, 44 is thereby monitored: when a permissible minimum filling is reached, the reservoir 43, 44 is raised by the compression spring 56 to such an extent that a sensor is loaded for the purpose of generating a signal. In the present case, this is an initiator 58 of known type which is attached to the support plate 51 and which reacts to variations in distance relative to the bottom wall 53.

In the present exemplary embodiment, the reservoirs 43, 44 have a quadratic cross-section (FIG. 7). They are reservoirs which are elongate, namely high in relation to the cross-sectional dimensions. For material, compressed air and sucking off, connections 59, 60 and 61 for hose or other conduits are provided in the region of a vertical side wall 62 of the reservoirs 43, 44. A connection 59 for the feed conduit 45 and discharge conduit 46, that is to say for the dyestuff, is located in the lower region of the reservoir 43, 44, directly above the bottom wall 53. The connection 60 serves for connecting the air conduit 47, 48. This connection is located in an upper head piece 63 of the reservoir 43, 44. The head piece 63 has, inside the reservoir 43, a tubular neck 64 which projects into the reservoir 43, 44 from above. Located in the tubular neck at a distance from the lower mouth is a perforated bottom 65, that is to say a transversely directed plate having bores. Accommodated above this, in the region of a filter space of the head piece 43, is filter material 66, for example filter wadding. The connection 60 is connected to the interior of the tubular neck 64 in the region of the filter space having the filter material 66. This arrangement is important, in particular, for the process of sucking off since by means of the tubular neck 64, in conjunction with the filter material 66, any residues of dyestuff can be retained in the reservoir 43, 44 or cannot pass into the air conduit 47, 48.

The tubular neck 64 or the space filled with filter material 66 is closed at the top by means of a cover plate 67.

The material conduits, namely feed conduit 45 and discharge conduit 46, which allow the dyestuff to circulate are connected to the dye container 30 on the underside of the latter. A circulation duct 68, U-shaped in the present case, is formed within the block-like dye container. Vertical duct legs 69, 70 lead to a horizontal transverse duct 71. The latter extends directly underneath the dye chamber 24 and is connected to this. The transverse duct 71 at the same time extends in the transversely axial direction relative to the dye roller 25.

Figure 10:
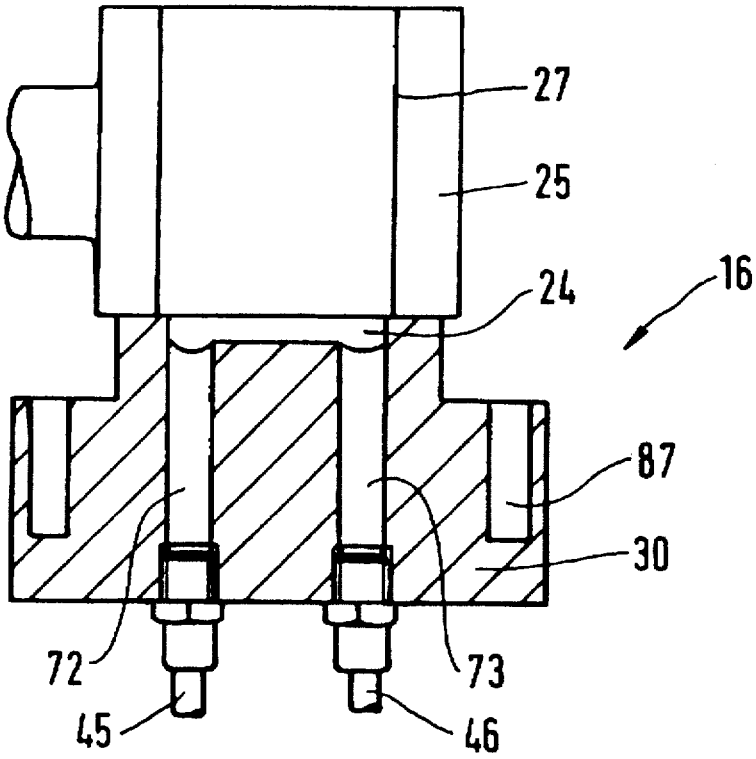
FIG. 10 shows the printing unit according to FIG. 9 in a vertical sectional plane X—X.
Figure 11:
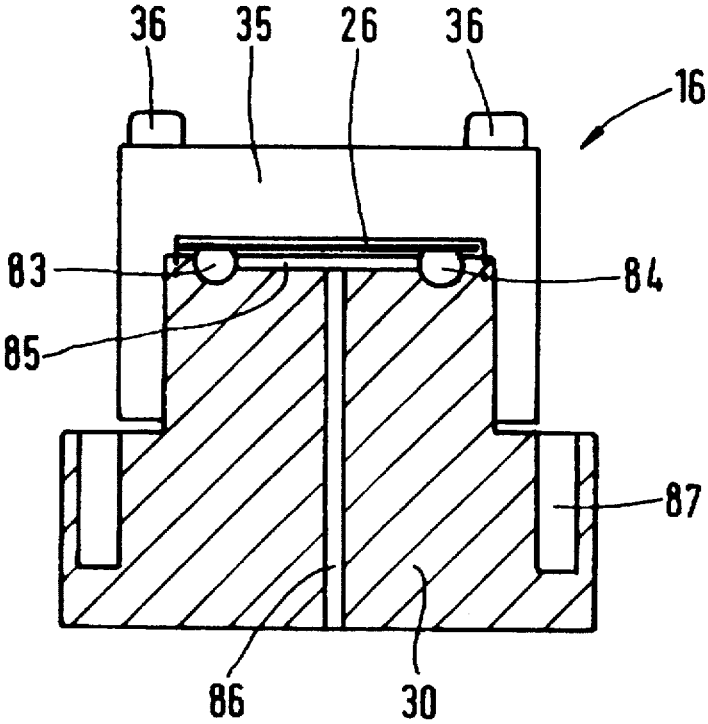
FIG. 11 shows the printing unit of FIG. 9 in an offset vertical sectional plane XI—XI.

The embodiment according to FIGS. 10 and 11 is intended for larger colour prints or markings with a correspondingly wide transfer region 27. The dye chamber 24 corresponds to these dimensions. In this exemplary embodiment, therefore, the dye chamber 24 is positioned as a duct-like or groove-shaped structure in axis-parallel alignment with the dye roller 25. The length of the dye chamber 24 in the axial direction is slightly smaller than the width of the transfer region 27.

The feed and discharge of the material or dyestuff take place, here, by means of two parallel dye ducts 72 and 73 which lead from the underside of the dye container 30 directly to the ends of the elongate dye chamber 24.

The printing unit 16 is equipped with particular measures for improving the sealing in the region of the dye chamber 24, which measures can also be employed in another context. Suction ducts 74, 76; 83, 84 for sucking off dyestuff residues which are taken along by the dye roller 25 open out on the cylindrical sealing surfaces 31, 32.

Figure 5:
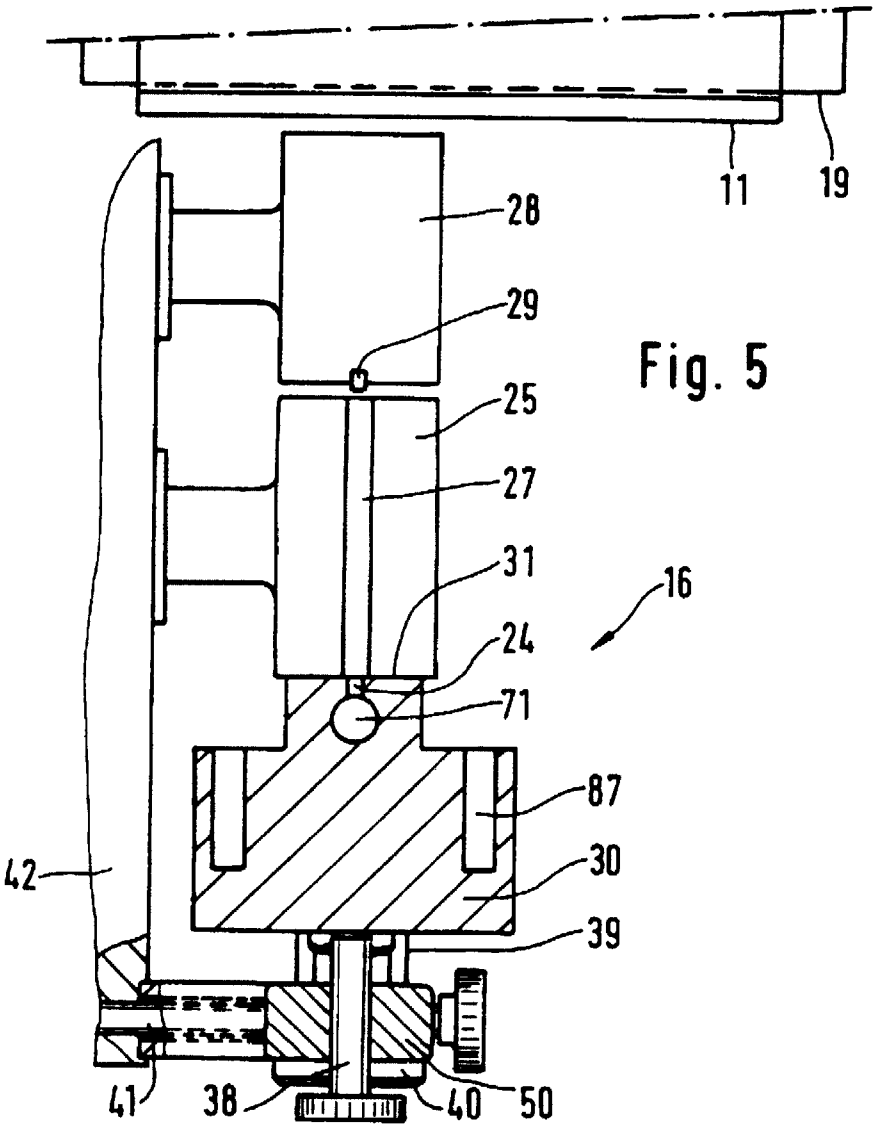
FIG. 5 shows a printing unit in a vertical section in the sectional plane V—V of FIG. 4.
Figure 6:
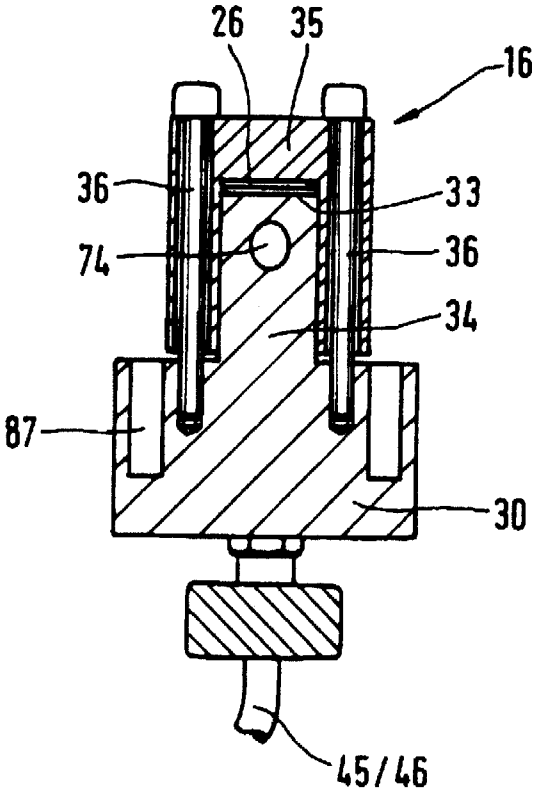
FIG. 6 shows the printing unit according to FIG. 4 in a vertical sectional plane VI—VI.

In a dye unit having a narrow transfer region 27 of the dye roller 25, that is to say in the exemplary embodiment of FIGS. 4 to 6, a central suction duct 74 is provided in the dye container 30. This suction duct 74 is arranged in the region of the exit-side sealing surface 31, specifically adjacently to the free edge of this sealing surface 31, that is to say where the circumference of the dye roller 25 leaves the region of the sealing surface 31. The suction duct 74 opens out centrally on the sealing surface 31. Dye residues which occur there are picked up by the suction duct 74 as a result of negative pressure in the latter. A transversely directed air bore 75 adjacent to the mouth of the suction duct 74 makes it possible to suck in extraneous air. The suction duct 74 is constantly connected to a negative pressure source while the printing unit 16 is in operation.

Additionally, in the present case, a further suction duct 76 is formed in the dye container 30 on the opposite side to the dye chamber 24. This suction duct 76 opens out on the entry-side sealing surface 32, specifically likewise adjacently to the free edge of the latter. This suction duct 76 too serves for picking up and removing any dye quantities still located on the circumference of the dye roller 25 in this region, specifically in the transfer region 27.

The suction ducts 74 and 76 are connected to the reservoirs 43, 44 via suction conduits 77 and 78, so that the dye residues picked up by the suction ducts 74, 76 are fed to the reservoirs 43, 44. The suction conduits 77, 78 open out in the upper region of the reservoirs 43, 44, specifically next to the tubular neck 64. As a result, the connections 61 assigned to these suction conduits 77, 78 do not come into contact with the supply of dyestuff in the reservoir 43, 44. The liquid level is kept to a level below the tubular neck 64.

Figure 3:
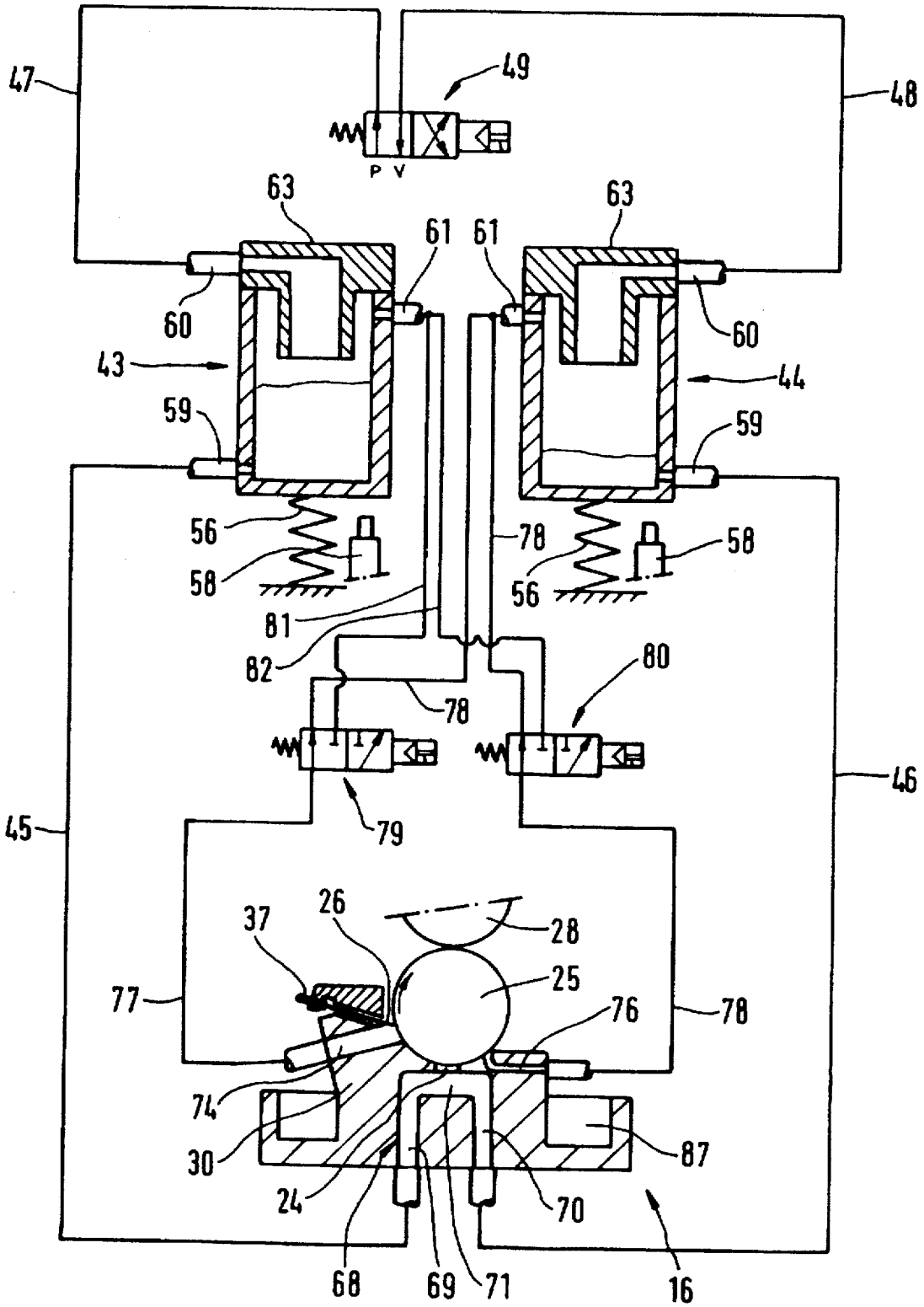
FIG. 3 shows a diagrammatic representation of a dye assembly.

Preferably or in the exemplary embodiment illustrated, the negative pressure in the suction conduits 77, 78 is generated by the negative pressure prevailing in the particular reservoir 43, 44 which is receiving dyestuff. This means that suction conduits 77, 78 are always connected to that reservoir 43, 44 which is under the influence of negative pressure. In the exemplary embodiment illustrated (FIG. 3), the suction conduits 77, 78 lead, in each case via a slide 79, 80, to the (right-hand) reservoir 44. A parallel conduit 81, 82 assigned to the two suction conduits 77, 78 is shut off in this position of the slides 79, 80. When the direction of flow of the liquid is changed over, therefore when the dyestuff flows from the reservoir 44 to the reservoir 43, the slides 79, 80 are also changed over. Negative pressure then prevails in the reservoir 43. The suction conduits 77, 78 are connected, via the then free parallel conduits 81, 82, to the reservoir 43, so that any dye residues pass into the latter.

The (larger) suction duct 74 formed on the exit side of the sealing surface 31 opens out directly below the stripper 26. Dyestuff quantities stripped off from the transfer region 27 by this thus pass directly into the mouth of the suction duct 74 and are discharged in the way described.

Figure 9:
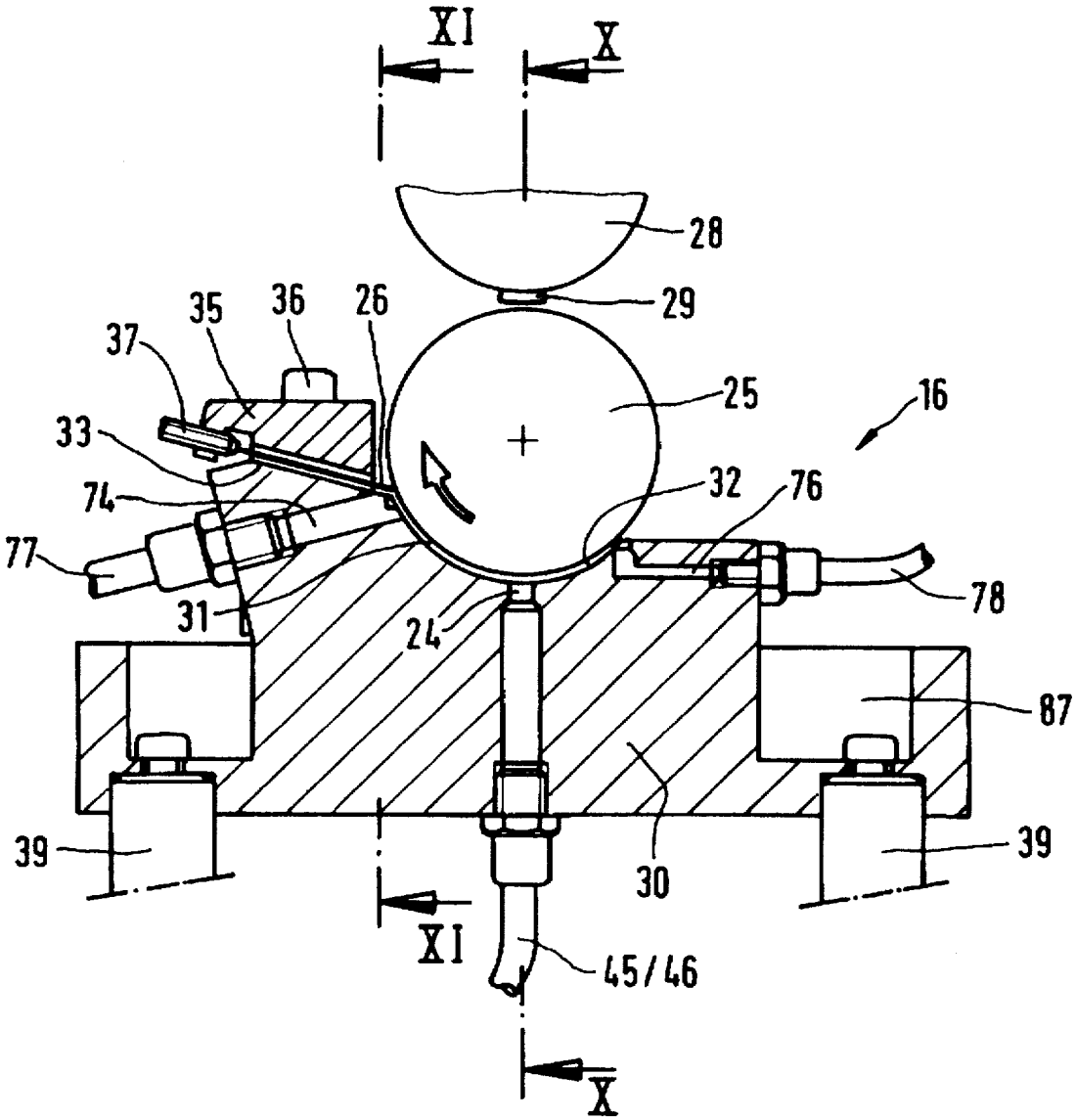
FIG. 9 shows a printing unit of another embodiment in a representation similar to that of FIG. 4.

In the exemplary embodiment according to FIGS. 9, 10 and 11 with a wide transfer region 27, two suction ducts 83, 84 (FIG. 11) arranged at a transverse distance from one another are provided. These lead via separate suction conduits or via a common suction conduit 77, 78 to the particular reservoir 43, 44 which is under negative pressure. The mouths of the suction ducts 83, 84 underneath the stripper 26 are connected to one another by means of a transversely directed connecting duct 85. The groove-like connecting duct 85 is open to the sealing surface 31 or to the stripper 26, so that dye quantities removed by the stripper 26 pass into the connecting duct 85 and from this into the suction ducts 83, 84. Air is fed via an air duct 86 directed transversely relative to the connecting duct 85 and connected centrally to the latter here.

The block-like dye container 30 is provided with an encircling dye trough 87. This is on top and serves for collecting any dye quantities not picked up. The dye trough 87 can be emptied in a suitable way not shown. It can be seen from the detail according to FIG. 4 and FIG. 9 that the guide bolts 39 penetrate on top into the dye trough 87, which is designed with a greater width here.

The above-described measures for eliminating quantities of liquid or of dye which necessarily occur in the region of the sealing surfaces 31, 32 or of the stripper 26 can also be employed in other printing or liquid systems having necessary sealing-off means.

What we claim is:

1. Method for coating of liquid dyestuffs onto film material webs or blanks for forming colour markings (10) on the film webs or blanks (11), with a printing unit (16) which has a dye chamber (24) and a rotating transfer dye roller (25), characterized in that:

a) the liquid dyestuff flows through the dye chamber (24) constantly or intermittently as a result of pressure acting on the liquid dyestuff in the region of an inlet side and/or negative pressure in the region of an outlet side of the dye chamber, b) the liquid dyestuff is conveyed through the dye chamber in a closed circuit, said closed circuit including a first reservoir (43,44), a conduit (45,46) connecting said dye chamber and said reservoir, and a discharge conduit (45,46) connecting said dye chamber and a second reservoir, said reservoirs being separate and the direction of flow between The reservoirs (43,44) being reversible and controlled by the pressure in the region of the dye chamber, c) the liquid dyestuff is transferred from the dye chamber to the film web or blank by the rotating transfer dye roller.

2. Process according to claim 1, characterized in that sealing regions are provided between the rotating transfer dye roller (25) and the dye chamber (24), and said sealing regions are subjected to negative pressure such, that any residues of the liquid dyestuff are constantly or discontinuously sucked off in the sealing regions.

3. Process according to claim 2, characterized in that the sucked-off residues of the dyestuff are introduced in to the closed circuit.

4. Apparatus for coating of liquid dyestuffs onto film material webs or blanks, with a printing unit (16) which has a dye chamber (24) and at least one movable print-coating member in the form of a rotary-driven dye roller (25), a partial region of the rotary driven dye roller (25) dipping into the dye chamber (24), and transfer means for transferring the liquid dyestuff from the rotary driven dye roller (25) to the film material webs or blanks, characterized in that:

a) the dye chamber (24) is connected to at least one feed conduit (45) and to at least one discharge conduit (46), by means of which the liquid dyestuff is fed to the dye chamber (24) and extracted from this constantly or discontinuously, and b) the dye chamber (24) is connected to a pair of reservoirs (43,44) via conduits including feed conduit (45) and discharge conduit (46), the liquid dyestuff in each case being, conveyed through the dye chamber (24) in a closed circuit, said closed circuit including a first one of said pair of reservoirs (43,44), a feed conduit (45) connecting said dye chamber and said reservoir, and a discharge conduit (461 connecting said dye chamber and a second one of said pair of reservoirs, said reservoirs being separate and the direction of flow between the reservoirs (43,44) being reversible and controlled by the pressure in the region of the dye chamber.

5. Apparatus according to claim 4, characterized in that the liquid dyestuff is conveyed through the dye chamber (24) under the influence of compressed air and/or negative pressure via air conduits (47,48) connected to the reservoirs (43,44), and each of the reservoirs (43,44) is alternatively subjected to compressed air and/or under negative pressure.

6. Apparatus according to claim 5, characterized in that at least one of the air conduits (47,48) is connected to each of the reservoirs (43,44) and is connected alternatively to a compressed-air source or to a negative-pressure source, in such a way that reservoir (43,44) dispensing dyestuff is connected by one of the air conduits to the compressed air source and the reservoir (43,44) receiving dyestuff is connected by one of the air conduits to the negative pressure source.

7. Apparatus for coating of liquid dyestuffs onto film material webs or blanks, for colour markings (10) onto the film webs or blanks (11), with a printing unit (16) which has a dye chamber (24), a rotary-driven dye roller (25), a partial region of the rotary-driven dye roller (25) dipping into the dye chamber (24), and transfer means for transferring the liquid dyestuff from the rotary-driven dye roller (25) to the film material or blanks, characterized in that:

a) the dye chamber (24) is pan of an upwardly open dye container (30), and in that the rotary-driven dye roller (25) is mounted above the dye chamber (24) and penetrates from above with a circumferential surface into the dye chamber (24) or into the liquid dyestuff, and b) the dye container (30) is vertically adjustable in position in relation to the rotary-driven dye roller (25) by means of an adjustable support of the dye container (30) on a carrier plate (50).

8. Apparatus according to claim 7, characterized in that the dye chamber (24) is designed as a groove, depression or bore which is open to the rotary-driven dye roller (25), and which has adjoining it a circulation duct (68) consisting of duct legs (69,70) and a transverse duct (71).

9. Apparatus according to claim 8, characterized in that a strip-shaped or annular transfer region (27) provided on the circumference of the dye roller (25), the rotary-driven dye chamber (24) is designed as a radially directed bore with a diameter approximately corresponding to the width of the annular transfer region (27) or as an axis-parallel duct with a length approximately corresponding to the width of the dye-coating surface.

10. Apparatus according to claim 9, characterized in that, in the dye chamber (24) is designed as an axis-parallel groove open to the rotary-driven dye roller (25) or as a duct or dye ducts (72,73) adjoin the ends of the dye chamber (24).

11. Apparatus for coating of liquid dyestuffs, onto film material webs or blanks for forming colour markings (10) onto the film webs or blanks (11 ), with a printing unit (16) which has a dye chamber (24), a rotary-driven dye roller (25), a partial region of the rotary-driven dye roller (25) dipping into the dye chamber (24), and transfer means for transferring the liquid dyestuff from the rotary driven dye roller (25) to the film material web or blank, characterized in that:

a) the dye chamber is part of an upwardly open dye container (30), and in that the rotary-driven dye roller (25) is mounted above the dye chamber (24) and penetrates from above with a circumferential surface into the dye chamber (24) and into the liquid dyestuff, and b) the dye container (30) has an externally encircling upwardly open dye trough (87) for receiving liquid dye residues, and c) the dye container (30) is vertically adjustable in position in relation to the rotary-driven dye roller (25) by means of an adjustable support of the dye container (30) on a carrier plate (50).

12. Apparatus for coating of liquid dyestuffs onto film material webs or blanks, for forming colour markings (10) onto film webs (11), with a printing unit (16) which has a dye chamber (24), a rotary-driven dye roller (25), a partial region of the rotary-driven dye roller (25) dipping into the dye chamber (24), and transfer means for transferring the liquid dyestuff from the rotary-driven dye roller (25) to the film material web or blank, characterized in that:

a) the dye chamber (24) is part of an upwardly open dye container (30), and in that the rotary-driven dye roller (25) is mounted above the dye chamber (24) and penetrates from above with a circumferential surface into the dye chamber (24) and into the liquid dyestuff, b) the dye container (30) has on both sides of the dye chamber (24) sealing surfaces (31,32) which are matched to the shape ad dimensions of the rotary-driven dye roller (25) and are designed as cylindrical surfaces, c) suction ducts (74,76,83,84) and/or a connecting duct (85) open out in the region of the sealing surfaces (31,32) of the dye container (30), in order to suck off excess liquid dye on the circumference of the rotary-driven dye roller (25) or on the sealing surfaces (31,32), preferably on edge regions of the sealing surfaces (31,32), d) reservoirs (43,44) for supplying the liquid dyestuffs to the dye chamber (24), the suction ducts (74,76,83,84) and/or connecting duct (85) picking up liquid dye residues are connected to the reservoirs (43,44) via suction conduits (77,78), the suction conduits (77,78) being connectable in each case by means of slides (79,80) to the reservoir (43,44) receiving liquid dyestuffs.

13. Apparatus according to claim 12, characterized in that the rotary-driven dye roller (25) rotates in a first direction and a stripper (26) is in proximity to the exit of the cylindrical surface of the rotary-driven dye roller (25) from the sealing surfaces (31) to strip off excess dye, and in that a suction duct (74) for sucking off such excess dye directly precedes the stripper (26) along the first direction of rotation of the rotary-driven dye roller, in such a way that stripped-off dye passes into the suction ducts (74).

* * * * *